US009267331B2

(12) United States Patent
Radford et al.

(10) Patent No.: US 9,267,331 B2
(45) Date of Patent: Feb. 23, 2016

(54) EXPANDABLE REAMERS AND METHODS OF USING EXPANDABLE REAMERS

(71) Applicant: Baker Hughes Incorporated, Houston, TX (US)

(72) Inventors: Steven R. Radford, The Woodlands, TX (US); Timothy Miller, Spring, TX (US); Marcus Oesterberg, Kingwood, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 386 days.

(21) Appl. No.: 13/794,251

(22) Filed: Mar. 11, 2013

(65) Prior Publication Data

US 2013/0256035 A1 Oct. 3, 2013

Related U.S. Application Data

(60) Provisional application No. 61/619,869, filed on Apr. 3, 2012.

(51) Int. Cl.
*E21B 10/32* (2006.01)
*E21B 7/28* (2006.01)

(52) U.S. Cl.
CPC . *E21B 10/32* (2013.01); *E21B 7/28* (2013.01); *E21B 10/322* (2013.01); *E21B 10/325* (2013.01)

(58) Field of Classification Search
CPC ..... E21B 10/322; E21B 10/32; E21B 10/325; E21B 17/1014; E21B 23/04; E21B 10/003; E21B 3/00; E21B 34/12; E21B 7/28; E21B 34/007
See application file for complete search history.

(56) References Cited

U.S. PATENT DOCUMENTS

| | | | |
|---|---|---|---|
| 1,678,075 | A | 7/1928 | Phipps |
| 2,069,482 | A | 2/1937 | Seay |
| 2,177,721 | A | 10/1939 | Johnson et al. |
| 2,344,598 | A | 3/1944 | Church |
| 2,754,089 | A | 7/1956 | Kammerer, Jr. |

(Continued)

FOREIGN PATENT DOCUMENTS

| | | | |
|---|---|---|---|
| EP | 246789 | A2 | 11/1987 |
| EP | 1036913 | A1 | 9/2000 |

(Continued)

OTHER PUBLICATIONS

Radford et al, U.S. Appl. No. 13/327,373 entitled, Selectively Actuating Expandable Reamers and Related Methods, filed Dec. 15, 2011.

(Continued)

*Primary Examiner* — Daniel P Stephenson
(74) *Attorney, Agent, or Firm* — TraskBritt

(57) ABSTRACT

Expandable reamers comprise a housing and at least one blade supported by the housing. The at least one blade is movable between an extended position and a retracted position. The at least one blade is in the retracted position when a travel sleeve is in a first sleeve position and a trigger sleeve is in an unobstructed position. The at least one blade is movable to the extended position when the travel sleeve is in a second sleeve position and the trigger sleeve is in the unobstructed position. The at least one blade is in the retracted position when the travel sleeve is in the second sleeve position and the trigger sleeve is in an obstructed position.

20 Claims, 4 Drawing Sheets

(56) References Cited

U.S. PATENT DOCUMENTS

| | | | |
|---|---|---|---|
| 2,758,819 | A | 8/1956 | Kammerer, Jr. |
| 2,834,578 | A | 5/1958 | Carr |
| 2,882,019 | A | 4/1959 | Carr et al. |
| 3,105,562 | A | 10/1963 | Stone et al. |
| 3,123,162 | A | 3/1964 | Rowley |
| 3,126,065 | A | 3/1964 | Chadderdon |
| 3,211,232 | A | 10/1965 | Grimmer |
| 3,224,507 | A | 12/1965 | Cordary, Jr. |
| 3,425,500 | A | 2/1969 | Fuchs |
| 3,433,313 | A | 3/1969 | Brown |
| 3,556,233 | A | 1/1971 | Gilreath |
| 4,098,335 | A | 7/1978 | Goad |
| 4,403,659 | A | 9/1983 | Upchurch |
| 4,458,761 | A | 7/1984 | Van Vreeswyk |
| 4,545,441 | A | 10/1985 | Williamson |
| 4,589,504 | A | 5/1986 | Simpson |
| 4,660,657 | A | 4/1987 | Furse et al. |
| 4,690,229 | A | 9/1987 | Raney |
| 4,693,328 | A | 9/1987 | Furse et al. |
| 4,842,083 | A | 6/1989 | Raney |
| 4,848,490 | A | 7/1989 | Anderson |
| 4,854,403 | A | 8/1989 | Ostertag et al. |
| 4,884,477 | A | 12/1989 | Smith et al. |
| 4,889,197 | A | 12/1989 | Boe |
| 5,139,098 | A | 8/1992 | Blake |
| 5,211,241 | A | 5/1993 | Mashaw et al. |
| 5,224,558 | A | 7/1993 | Lee |
| 5,265,684 | A | 11/1993 | Rosenhauch |
| 5,293,945 | A | 3/1994 | Rosenhauch et al. |
| 5,305,833 | A | 4/1994 | Collins |
| 5,318,131 | A | 6/1994 | Baker |
| 5,318,137 | A | 6/1994 | Johnson et al. |
| 5,318,138 | A | 6/1994 | Dewey et al. |
| 5,332,048 | A | 7/1994 | Underwood et al. |
| 5,343,963 | A | 9/1994 | Bouldin et al. |
| 5,361,859 | A | 11/1994 | Tibbitts |
| 5,368,114 | A | 11/1994 | Tandberg et al. |
| 5,375,662 | A | 12/1994 | Echols, III et al. |
| 5,425,423 | A | 6/1995 | Dobson et al. |
| 5,437,308 | A | 8/1995 | Morin et al. |
| 5,553,678 | A | 9/1996 | Barr et al. |
| 5,560,440 | A | 10/1996 | Tibbitts et al. |
| 5,740,864 | A | 4/1998 | de Hoedt et al. |
| 5,788,000 | A | 8/1998 | Maury et al. |
| 5,823,254 | A | 10/1998 | Dobson et al. |
| 5,887,655 | A | 3/1999 | Haugen et al. |
| 6,039,131 | A | 3/2000 | Beaton |
| 6,059,051 | A | 5/2000 | Jewkes et al. |
| 6,109,354 | A | 8/2000 | Ringgenberg et al. |
| 6,116,336 | A | 9/2000 | Adkins et al. |
| 6,131,675 | A | 10/2000 | Anderson |
| 6,189,631 | B1 | 2/2001 | Sheshtawy |
| 6,213,226 | B1 | 4/2001 | Eppink et al. |
| 6,227,312 | B1 | 5/2001 | Eppink et al. |
| 6,289,999 | B1 | 9/2001 | Dewey et al. |
| 6,325,151 | B1 | 12/2001 | Vincent et al. |
| 6,378,632 | B1 | 4/2002 | Dewey |
| 6,488,104 | B1 | 12/2002 | Eppink et al. |
| 6,494,272 | B1 | 12/2002 | Eppink et al. |
| 6,615,933 | B1 | 9/2003 | Eddison |
| 6,668,949 | B1 | 12/2003 | Rives |
| 6,708,785 | B1 | 3/2004 | Russell et al. |
| 6,732,817 | B2 | 5/2004 | Dewey et al. |
| 7,048,078 | B2 | 5/2006 | Dewey et al. |
| 7,314,099 | B2 | 1/2008 | Dewey et al. |
| 7,493,971 | B2 | 2/2009 | Nevlud et al. |
| 7,513,318 | B2 | 4/2009 | Underwood et al. |
| 7,900,717 | B2 | 3/2011 | Radford et al. |
| 8,028,767 | B2 | 10/2011 | Radford et al. |
| 2002/0070052 | A1 | 6/2002 | Armell |
| 2003/0029644 | A1 | 2/2003 | Hoffmaster et al. |
| 2003/0155155 | A1 | 8/2003 | Dewey et al. |
| 2006/0144623 | A1 | 7/2006 | Ollerensaw |
| 2007/0095573 | A1 | 5/2007 | Telfer |
| 2008/0128169 | A1 | 6/2008 | Radford et al. |
| 2010/0288557 | A1 | 11/2010 | Radford |
| 2011/0073330 | A1* | 3/2011 | Radford ..... 166/387 |
| 2011/0073370 | A1 | 3/2011 | Gentry |
| 2011/0073371 | A1 | 3/2011 | Radford |
| 2011/0073376 | A1 | 3/2011 | Radford et al. |
| 2011/0155465 | A1 | 6/2011 | Allamon et al. |
| 2011/0284233 | A1 | 11/2011 | Wu et al. |
| 2013/0153300 | A1 | 6/2013 | Radford et al. |
| 2013/0256035 | A1* | 10/2013 | Radford et al. ..... 175/57 |

FOREIGN PATENT DOCUMENTS

| | | | |
|---|---|---|---|
| EP | 1044314 | A1 | 3/2005 |
| GB | 2328964 | A | 3/1999 |
| GB | 2344607 | A | 6/2000 |
| GB | 2344122 | B | 4/2003 |
| WO | 0031371 | A1 | 6/2000 |

OTHER PUBLICATIONS

International Search Report for International Application No. PCT/US2013/035112 mailed Jul. 18, 2013, 4 pages.

International Written Opinion for International Application No. PCT/US2013/035112 mailed Jul. 18, 2013, 4 pages.

* cited by examiner

EXPANDABLE REAMERS AND METHODS OF USING EXPANDABLE REAMERS

CROSS-REFERENCE TO RELATED APPLICATIONS

This application claims the benefit of U.S. Provisional Patent Application Ser. No. 61/619,869, filed Apr. 3, 2012, the disclosure of which is incorporated herein in its entirety by this reference. The subject matter of the present application is related to the subject matter disclosed in U.S. patent application Ser. No. 13/327,373 filed Dec. 15, 2011, now U.S. Pat. No. 8,960,333, issued Feb. 24, 2015 to Radford et al., the disclosure of which is incorporated herein in its entirety by this reference.

FIELD

The disclosure relates generally to expandable reamers for use in boreholes in subterranean formations and methods of using such expandable reamers. More specifically, disclosed embodiments relate to expandable reamers that selectively extend and retract blades.

BACKGROUND

Expandable reamers are generally employed for enlarging boreholes in subterranean formations. In drilling oil, gas, and geothermal wells, casing is usually installed and cemented to prevent the walls of the borehole from caving in while providing requisite shoring for subsequent drilling to greater depths. Casing is also installed to isolate different formations, to prevent cross flow of formation fluids, and to enable control of formation fluids and pressure as the borehole is drilled. To increase the depth of a previously drilled borehole, new casing is laid within and extended below the original casing. The diameter of any subsequent sections of the well may be reduced because the drill bit and any further casing must pass through the original casing. Such reductions in the borehole diameter may limit the production flow rate of oil and gas through the borehole. Accordingly, a borehole may be enlarged in diameter when installing additional casing to enable better production flow rates of hydrocarbons through the borehole.

One approach used to enlarge a borehole involves employing an extended bottom-hole assembly with a pilot drill bit at the end and a reamer assembly some distance above the pilot drill bit. This arrangement permits the use of any standard rotary drill bit type (e.g., a rolling cone bit or a fixed-cutter bit), as the pilot bit and the extended nature of the assembly permit greater flexibility when passing through tight spots in the borehole as well as the ability to stabilize the pilot drill bit so that the pilot drill bit and the following reamer will traverse the path intended for the borehole. This aspect of an extended bottom-hole assembly is particularly significant in directional drilling. Expandable reamers are disclosed in, for example, U.S. Pat. No. 7,900,717 issued Mar. 8, 2011, to Radford et al.; U.S. Pat. No. 8,028,767 issued Oct. 4, 2011, to Radford et al.; and U.S. Patent Application Pub. No. 2011/0073371 published Mar. 31, 2011, to Radford, the disclosure of each of which is incorporated herein in its entirety by this reference. The blades in such expandable reamers are initially refracted to permit the tool to be run through the borehole on a drill string, and, once the tool has passed beyond the end of the casing, the blades are extended so the bore diameter may be increased below the casing.

BRIEF SUMMARY

In some embodiments, expandable reamers for use in boreholes in subterranean formations comprise a housing defining an internal bore. At least one blade is supported by the housing. The at least one blade is movable between an extended position and a retracted position. A travel sleeve is located within the internal bore and detachably connected to the housing. The travel sleeve defines an internal flow path and comprises a first obstruction engagement, at least one first port at a first longitudinal position, and at least one second port at a second, upper longitudinal position. The travel sleeve is located in a first sleeve position when connected to the housing and is movable from the first sleeve position to a second, different sleeve position when disconnected from the housing. A trigger sleeve is located within the internal flow path and detachably connected to the travel sleeve. The trigger sleeve defines an internal flow bore and comprises a sidewall, a second obstruction engagement, and at least one trigger port. The trigger sleeve is located in an unobstructed position when connected to the travel sleeve and is movable from the unobstructed position to an obstructed position when disconnected from the travel sleeve. The at least one trigger port is at least substantially aligned with the at least one second port when the trigger sleeve is in the unobstructed position and the sidewall obstructs the at least one second port when the trigger sleeve is in the obstructed position. The at least one blade is in the retracted position when the travel sleeve is in the first sleeve position and the trigger sleeve is in the unobstructed position. The at least one blade is movable to the extended position when the travel sleeve is in the second sleeve position and the trigger sleeve is in the unobstructed position. The at least one blade is in the retracted position when the travel sleeve is in the second sleeve position and the trigger sleeve is in the obstructed position.

In other embodiments, methods of using expandable reamers in boreholes comprise flowing a drilling fluid through an internal bore defined by a housing, through an internal flow path defined by a travel sleeve located within the internal bore and detachably connected to the housing, and through an internal flow bore defined by a trigger sleeve located within the internal flow path and detachably connected to the travel sleeve. A first obstruction is released into the internal bore to engage with a first obstruction engagement of the travel sleeve. The travel sleeve is disconnected from the housing and the travel sleeve is allowed to move from a first sleeve position to a second, lower sleeve position when the first obstruction is engaged with the first obstruction engagement. At least one blade supported by the housing is extended from a retracted position to an extended position in response to movement of the travel sleeve from the first sleeve position to the second sleeve position. A second obstruction is released into the internal bore to engage with a second obstruction engagement of the trigger sleeve. The trigger sleeve is disconnected from the travel sleeve and the trigger sleeve is allowed to move from an unobstructed position wherein at least one trigger port of the trigger sleeve is at least substantially aligned with at least one second port of the travel sleeve to an obstructed position wherein a sidewall of the trigger sleeve obstructs the at least one second port. Flow of the drilling fluid is redirected from the at least one second port through the internal flow path. The at least one blade is allowed to retract from the extended position to the retracted position in response to the redirected flow of the drilling fluid.

BRIEF DESCRIPTION OF THE DRAWINGS

While the specification concludes with claims particularly pointing out and distinctly claiming what are regarded as embodiments of the invention, various features and advantages of disclosed embodiments may be more readily ascertained from the following description when read in conjunction with the accompanying drawings, in which:

DETAILED DESCRIPTION

The illustrations presented herein are not meant to be actual views of any particular expandable reamer or component thereof, but are merely idealized representations employed to describe illustrative embodiments. Thus, the drawings are not necessarily to scale. Additionally, elements common between figures may retain the same or similar numerical designation.

Disclosed embodiments relate generally to expandable reamers, which selectively extend and retract blades. More specifically, disclosed are expandable reamers, which, for example, may be locked in a retracted position during placement into a borehole, may be selectively actuated between an extended position and a retracted position during drilling, and may be selectively returned to the retracted position during removal from the borehole.

As used herein, the terms "upper," "lower," "below," and "above" indicate relative positions of an earth-boring tool when positioned for normal use in a vertical borehole, and are not intended to limit the use of such an earth-boring tool to vertical or near-vertical drilling applications.

As used herein, the term "drilling fluid" means and includes any fluid that is directed down a drill string during drilling of a subterranean formation. For example, drilling fluids include liquids, gases, combinations of liquids and gases, fluids with solids in suspension with the fluids, oil-based fluids, water-based fluids, air-based fluids, and muds.

Figure 1:
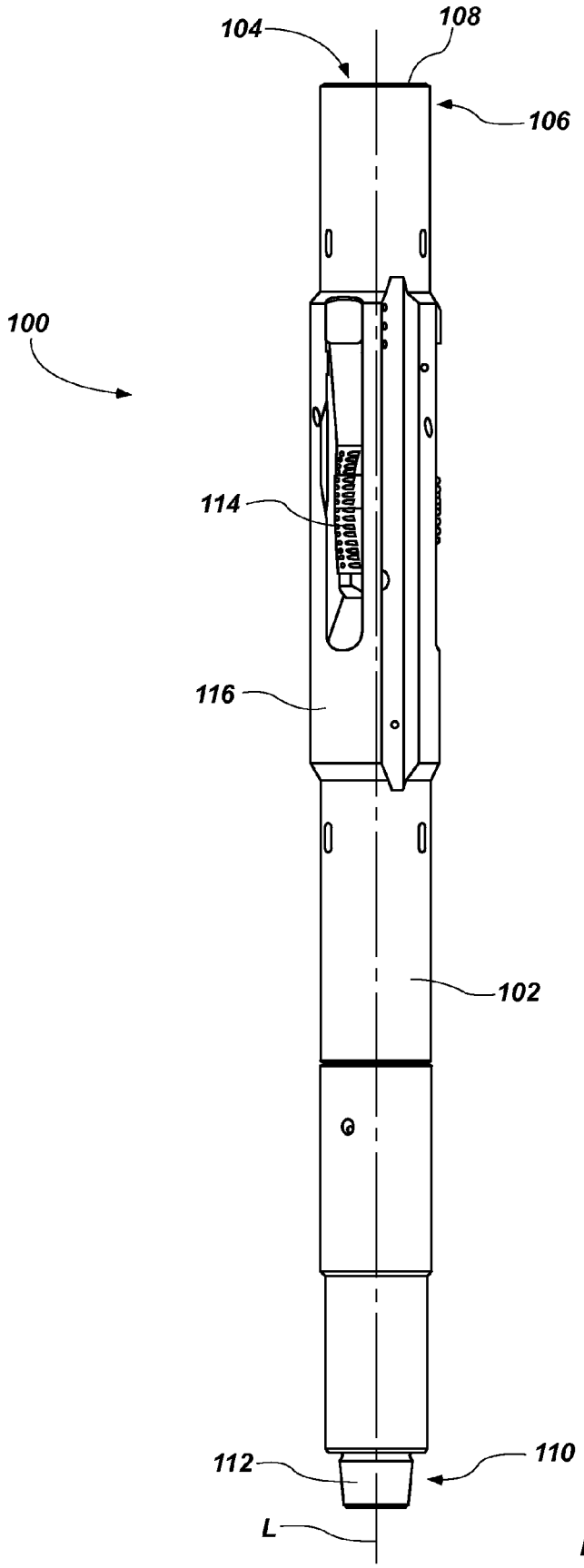
FIG. 1 is a perspective view of an expandable reamer.
Figure 3:
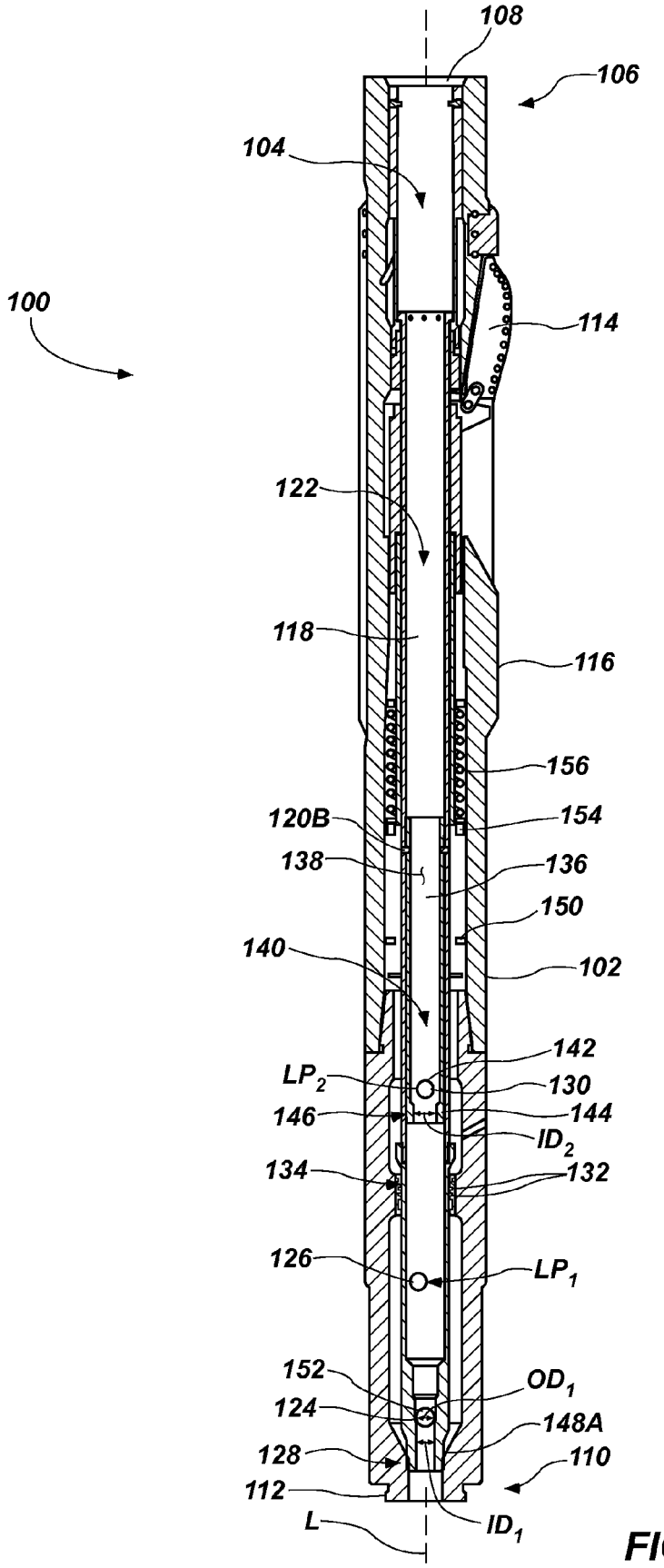
FIG. 3 is a cross-sectional view of the expandable reamer of FIG. 1 in a second operational state.
Figure 4:
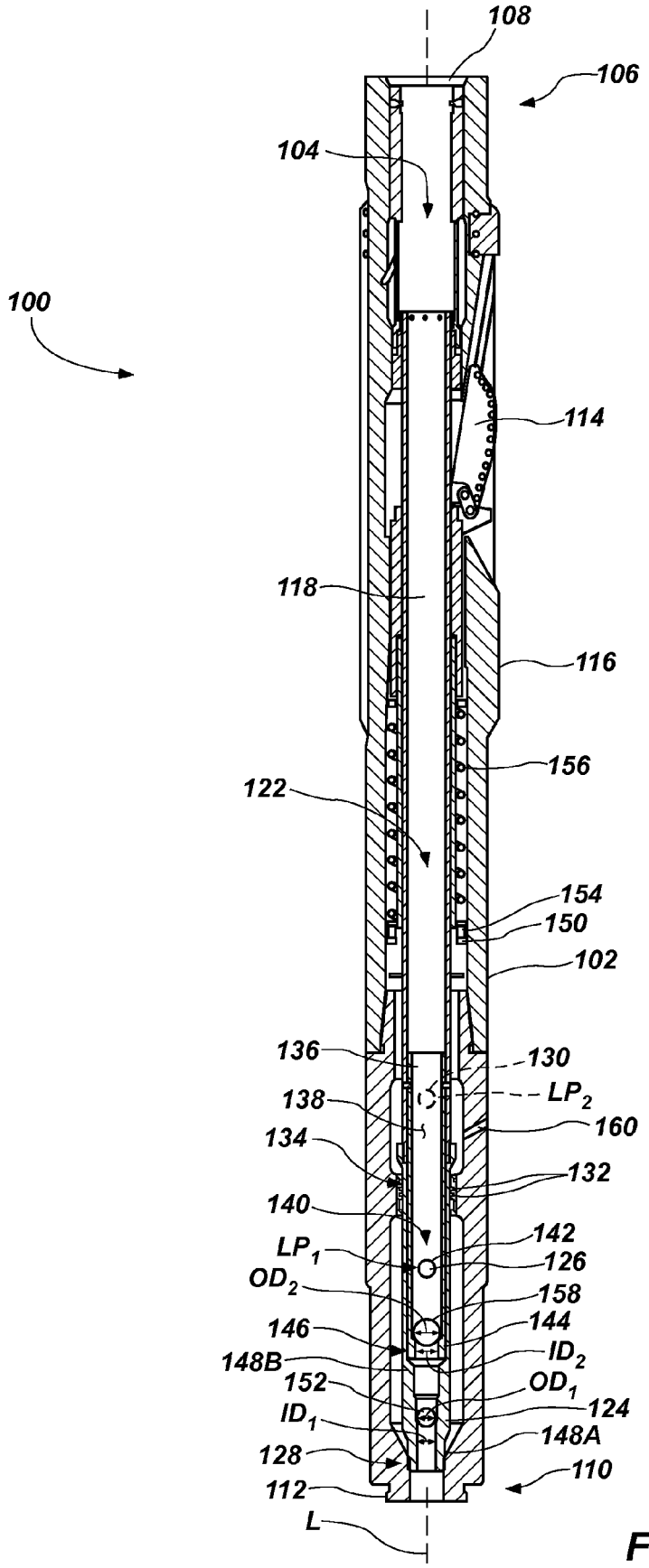
FIG. 4 is a cross-sectional view of the expandable reamer of FIG. 1 in a third operational state.

Referring to FIG. 1, a perspective view of an expandable reamer 100 is shown. The expandable reamer 100 includes a housing 102 comprising a generally cylindrical structure defining an internal bore 104 through which drilling fluid may flow and having a longitudinal axis L (e.g., a central axis within the internal bore 104). The housing 102 may be configured to connect to other sections of a drill string. For example, an upper end 106 of the housing 102 may comprise a first connector 108 (e.g., a box connection) and a lower end 110 of the housing 102 may comprise a second connector 112 (e.g., a pin connection), each of which may be connected to other components in the drill string, such as, for example, sections of drill pipe, sections of casing, sections of liner, stabilizers, downhole motors, pilot drill bits, drill collars, etc. The housing 102 may support at least one blade 114, to which cutting elements may be secured, configured to engage with and remove material from a wall of a borehole. Each blade 114 may be movable between a retracted position, as shown in FIGS. 1, 2, and 4, in which each blade 114 is positioned not to engage with the wall of the borehole (though some incidental contact may occur) and an extended position, as shown in FIG. 3, in which each blade 114 is positioned to engage with the wall of the borehole.

The expandable reamer 100 may optionally include stabilizers 116 extending radially outwardly from the housing 102. Such stabilizers 116 may center the expandable reamer 100 in the borehole while tripping into position through a casing or liner string and while reaming the borehole by contacting and sliding against the wall of the borehole. In other embodiments, the expandable reamer 100 may lack such stabilizers 116.

Figure 2:
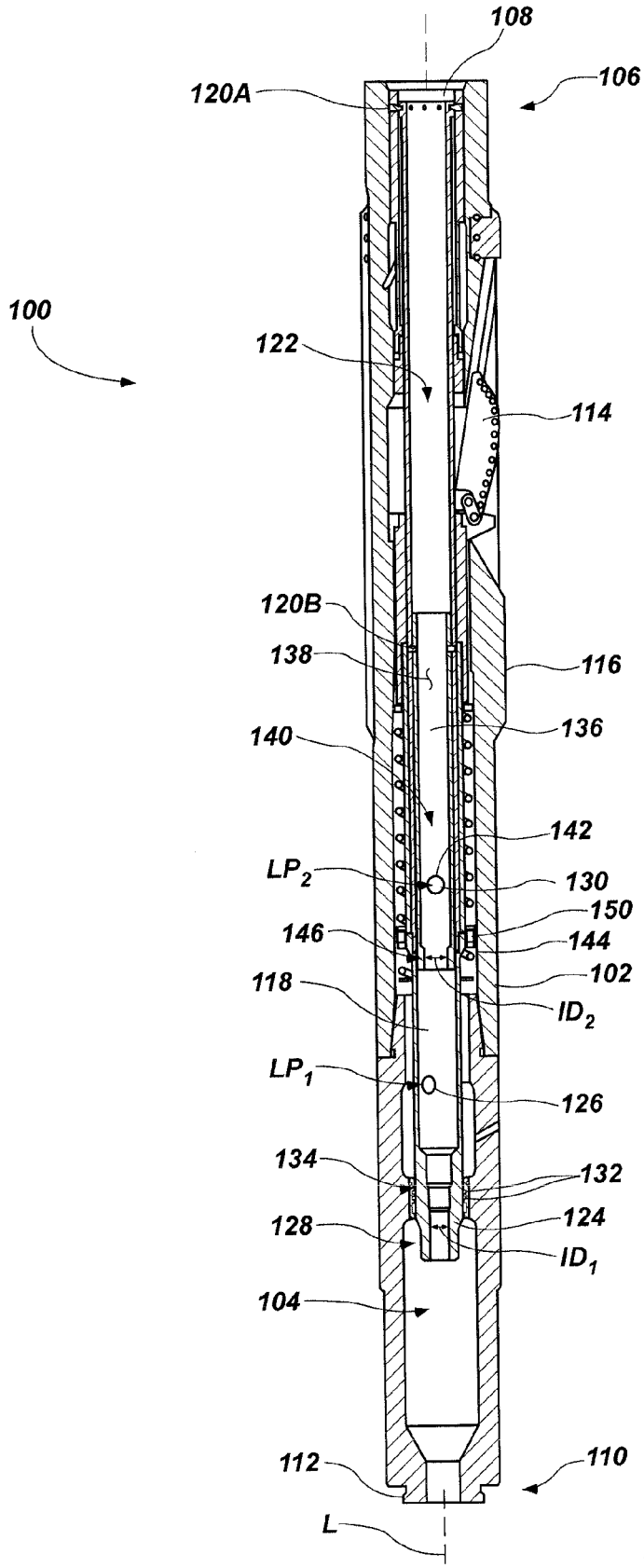
FIG. 2 is a cross-sectional view of the expandable reamer of FIG. 1 in a first operational state.

Referring to FIG. 2, a cross-sectional view of the expandable reamer 100 of FIG. 1 is shown in a first operational state (e.g., a first mode of operation). Such a first operational state may correspond to a pre-actuation, initial, retracted state, and may reflect a state of the expandable reamer 100 when tripping into a borehole. The expandable reamer 100 may comprise an actuation mechanism configured to selectively position the blades 114 in their retracted and extended positions.

The actuation mechanism may include a travel sleeve 118 located within the internal bore 104 and detachably connected to the housing 102. For example, the travel sleeve 118 may be connected to the housing using detachable hardware 120A, which may comprise, for example, shear screws, shear pins, exploding bolts, or locking dogs. The travel sleeve 118 may comprise a generally cylindrical structure defining an internal flow path 122 through which drilling fluid may flow and may comprise a first obstruction engagement 124. The first obstruction engagement 124 may comprise, for example, a ball seat, a ball trap, a solid seat, an expandable seat, or other obstruction engagements known in the art, and may be configured to engage with a first obstruction 152 (see FIGS. 3 and 4) to actuate the actuation mechanism. The travel sleeve 118 may comprise at least one first port 126 at a first longitudinal position $LP_1$ through which drilling fluid may flow from the internal flow path 122 to the internal bore 104 or vice versa. For example, the travel sleeve 118 may include multiple first ports 126 proximate a lower end 128 of the travel sleeve 118. The travel sleeve 118 may comprise at least one second port 130 at a second, different longitudinal position $LP_2$ through which drilling fluid may flow from the internal flow path 122 to the internal bore 104 or vice versa. For example, the travel sleeve 118 may include multiple second ports 130 located at a second, upper longitudinal position $LP_2$, as compared to a first, lower longitudinal position $LP_1$ of the first ports 126.

The travel sleeve 118 may be configured to move relative to the housing 102 when disconnected from the housing 102. For example, the travel sleeve 118 may be in a first sleeve position when connected to the housing 102, as shown in FIG. 2, in the first operational state. The travel sleeve 118 may move to a second, different sleeve position when disconnected from the housing 102, as shown in FIGS. 3 and 4, in subsequent states of the expandable reamer 100.

The expandable reamer 100 may include at least one sealing member 132 interposed between the housing 102 and the travel sleeve 118 to form a seal 134 between the housing 102 and the travel sleeve 118. For example, a plurality of sealing members 132 may be interposed between the housing 102 and the travel sleeve 118 proximate the lower end 128 of the travel sleeve 118, forming a seal 134 between the housing 102 and the travel sleeve 118. The sealing members 132 may comprise, for example, o-rings, omni-directional sealing rings (i.e., sealing rings that prevent flow from one side of the sealing rings to the other side of the sealing rings regardless of flow direction), unidirectional sealing rings (i.e., sealing rings that prevent flow from one side of the sealing ring to the other side of the sealing ring in only one flow direction), V-packing, and other members for forming seals between components of expandable reamers 100 known in the art. As a specific, non-limiting example, the sealing members 132 may comprise D-seal elements, which may comprise flexible and compressible tubular members having "D" shaped cross-sections extending circumferentially to form annular members. The lower end 128 of the travel sleeve 118 may be located below the seal 134, but above and distanced from the lower end 110 of the housing 102. In the first operational state, both the first and second ports 126 and 130 may be located on a common first side (e.g., an upper side) of the sealing members 132.

The actuation mechanism of the expandable reamer 100 may comprise a trigger sleeve 136 located within the internal flow path 122 and detachably connected to the travel sleeve 118. For example, the trigger sleeve 136 may be connected to the travel sleeve 118 by detachable hardware 120B, which may comprise, for example, shear screws, shear pins, exploding bolts, or locking dogs. The trigger sleeve 136 may comprise a generally cylindrical structure including a sidewall 138 defining an internal flow bore 140 through which drilling fluid may flow. The trigger sleeve 136 may comprise at least one trigger port 142 extending through the sidewall 138 through which drilling fluid may flow from the internal flow bore 140 to the internal bore 104 and the internal flow path 122 and vice versa. For example, the trigger sleeve 136 may comprise multiple trigger ports 142. The trigger ports 142 may be at least substantially aligned with the second ports 130 of the travel sleeve 118 when the trigger sleeve 136 is connected to the travel sleeve 118. When it is said that the trigger ports 142 may be "at least substantially aligned" with the second ports 130, what is meant is that there is at least some overlap between the trigger ports 142 and the second ports 130 such that drilling fluid may flow directly from the internal flow bore 140 of the trigger sleeve 136, through the trigger and second ports 142 and 130, into the internal bore 104 of the housing 102. The trigger sleeve 136 may comprise a second obstruction engagement 144, which may comprise, for example, a ball seat, a ball trap, a solid seat, an expandable seat, or other obstruction engagements known in the art, at a lower end 146 of the trigger sleeve 136 and may be configured to engage with a second obstruction 158 (see FIG. 4) to deactivate the actuation mechanism. A second inner diameter $ID_2$ of the second obstruction engagement 144 may be greater than a first inner diameter $ID_1$ of the first obstruction engagement 124, which may enable relatively smaller obstructions to pass through the second obstruction engagement 144 to engage with the first obstruction engagement 124.

The trigger sleeve 136 may be configured to move relative to the travel sleeve 118 when disconnected from the travel sleeve 118. For example, the trigger sleeve 136 may be in an unobstructed position when connected to the travel sleeve 118, as shown in FIGS. 2 and 3, in which the trigger sleeve 136 may not obstruct (e.g., may not significantly impede) drilling fluid flow through the second ports 130 of the travel sleeve 118 because of the at least substantial alignment between the trigger ports 142 and the second ports 130. The trigger sleeve 136 may move to an obstructed position when disconnected from the travel sleeve 118, as shown in FIG. 3, in which the sidewall 138 of the trigger sleeve 136 may obstruct (e.g., may significantly impede or prevent) drilling fluid flow through the second ports 130 of the travel sleeve 118.

When in the first operational state, the blades 114 of the expandable reamer 100 are in the retracted position regardless of pressure of the drilling fluid within the expandable reamer 100. For example, locking dogs 150 that may be held in place by the travel sleeve 118 may lock the blades 114 in the retracted position. Such locking of the blades 114 may retain the blades 114 in the refracted position regardless of pressure exerted by drilling fluid against any component of the actuation mechanism. For example, the pressure exerted by the drilling fluid may be increased or decreased without causing the blades 114 to move from the retracted position to the extended position. The travel sleeve 118 may be in the first, upper sleeve position in the first operational state. For example, the detachable hardware 120A may retain the travel sleeve 118 in the first, upper sleeve position. The trigger sleeve 136 may be in the unobstructed position in the first operational state. For example, the detachable hardware 120B may retain the trigger sleeve 136 in the unobstructed position. Drilling fluid may flow from the upper end 106 of the housing 102 to the lower end 110 of the housing 102 through the internal bore 104 of the housing 102, the internal flow path 122 of the travel sleeve 118, the internal flow bore 140 of the trigger sleeve 136, the first, second, and trigger ports 126, 130, and 142. The drilling fluid may then flow to other, lower components in the drill string, such as, for example, a downhole motor, a drill collar, and a pilot bit. Accordingly, the blades 114 may be in the retracted position, the travel sleeve 118 may be in the first sleeve position, and the trigger sleeve 136 may be in the unobstructed position when the expandable reamer 100 is in the first operational state.

Referring to FIG. 3, a cross-sectional view of the expandable reamer 100 of FIG. 1 is shown in a second operational state (e.g., a second mode of operation). Such a second operational state may correspond to an actuated, subsequent, extendable state, and may reflect a state of the expandable reamer 100 when drilling the borehole. The actuation mechanism of the expandable reamer 100 may be actuated to selectively position the blades 114 in their extended positions.

To place the expandable reamer 100 in the second operational state, a first obstruction 152 may be released into the internal bore 104 to engage with the first obstruction engagement 124 of the travel sleeve 118. The first obstruction 152 may comprise, for example, a ball, a sphere, an ovoid, or other three-dimensional shape that may be released into the internal bore 104 to engage with the first obstruction engagement 124 and at least partially impede flow of drilling fluid out the lower end 128 of the travel sleeve 118. A first outer diameter $OD_1$ of the first obstruction 152 may be smaller than the second inner diameter $ID_2$ of the second obstruction engagement 144 and larger than the first inner diameter $ID_1$ of the first obstruction engagement 124, which may enable the first obstruction 152 to pass through the second obstruction engagement 144 and engage with (e.g., become lodged in) the first obstruction engagement 124.

After engaging with the first obstruction engagement 124, drilling fluid pressure against the first obstruction 152 may increase as flow out the lower end 128 of the travel sleeve 118 is at least partially impeded. The pressure exerted by the drilling fluid may be sufficient to disconnect the travel sleeve 118 from the housing 102. For example, the pressure exerted by the drilling fluid may produce a shear stress within the detachable hardware 120A greater than a shear strength of the detachable hardware 120A (see FIG. 2) to shear the detachable hardware 120A in embodiments where the detachable hardware 120A comprises shear pins or shear screws. The pressure exerted by the drilling fluid may then cause the travel sleeve 118 to move from the first sleeve position to a second, different sleeve position. For example, the pressure may cause the travel sleeve 118 to move from a first, upper sleeve position to a second, lower sleeve position. Movement of the travel sleeve 118 may be arrested in the second sleeve position by reducing or relieving the pressure exerted by the drilling fluid, by abutting the lower end 128 of the travel sleeve 118 against the housing 102 (e.g., against a sleeve stop 148A of the housing 102), or both. In embodiments where the lower end 128 of the travel sleeve 118 abuts the sleeve stop 148A, a seal may not be formed between the travel sleeve 118 and the sleeve stop 148A to enable drilling fluid to still flow out the first ports 126, into the internal bore 104, and out of the housing 102. For example, the lower end 128 of the travel sleeve 118, the sleeve stop 148A, or both may comprise a scalloped edge or a scalloped surface to create a space in which drilling fluid may flow. The trigger sleeve 136 may remain detachably connected to the travel sleeve 118 and move with the travel sleeve 118 as the travel sleeve 118 moves to the second sleeve position.

When the travel sleeve 118 moves from the first sleeve position to the second sleeve position, the first ports 126 of the travel sleeve 118 may move from a first side of the sealing members 132 to a second, opposing side of the sealing members 132. For example, the first ports 126 may move from a first side above the sealing members 132 (see FIG. 2) to a second side below the sealing members 132. Drilling fluid may then escape from the internal flow path 122 of the travel sleeve 118, through the first ports 126, to the internal bore 104 of the housing 102, and out the lower end 110 of the housing 102 to at least partially relieve the pressure exerted by the drilling fluid against the first obstruction 152.

Movement of the travel sleeve 118 from the first sleeve position to the second sleeve position may release the locking dogs 150, which previously retained the blades 114 in the retracted position. For example, the locking dogs 150 may bear against the travel sleeve 118 and a push sleeve 154 connected to the blades 114 when the travel sleeve 118 is in the first sleeve position. Movement of the travel sleeve 118 to the second sleeve position may cause the locking dogs 150 to cease bearing against the travel sleeve 118 and the push sleeve 154, which may enable the push sleeve 154 to move the blades 114 to the extended position. For example, drilling fluid flowing in the internal bore 104 of the housing 102 (e.g., drilling fluid flowing outside the travel sleeve 118 in the internal bore 104 and drilling fluid flowing from the internal flow bore 140 of the trigger sleeve 136, through the trigger ports 142 and the second ports 130 with which they may be at least substantially aligned, and into the internal bore 104) may exert a pressure against the push sleeve 154 to move the push sleeve 154, which may cause the blades 114 to move correspondingly to the extended position. When in the extended position, the blades 114 may engage a wall of the borehole to remove formation material and enlarge the borehole diameter as the expandable reamer 100 rotates in the borehole.

The blades 114 may be biased toward the retracted position. For example, a biasing member 156 (e.g., a spring) may bear against the push sleeve 154 and the housing 102 to bias the blades 114 toward the retracted position. The pressure of the drilling fluid may be sufficient to overcome the bias of the blades 114 toward the refracted position to move the blades 114 to the extended position. For example, the pressure exerted by the drilling fluid may produce a force exerted against the push sleeve 154 greater than a force exerted by the biasing member 156 against the push sleeve 154. The pressure exerted by the drilling fluid against the push sleeve 154 may move the push sleeve 154, overcome the bias of the biasing member 156 (e.g., by compressing the biasing member 156), and cause the blades 114 to move to the extended position.

Increasing or decreasing the pressure exerted by the drilling fluid may cause the blades 114 to move selectively between the extended position and the retracted position while the expandable reamer 100 is in the second operational state. For example, the pressure exerted by the drilling fluid may be reduced below the pressure exerted by the biasing member 156, which may cause the biasing member 156 to expand and bear against the push sleeve 154. The push sleeve 154 may move in response to the expansion of the biasing member 156, and the blades 114 may be returned to the retracted position. The pressure exerted by the drilling fluid may be increased above the pressure exerted by the biasing member 156, which may cause the push sleeve 154 to compress the biasing member 156. The push sleeve 154 may move as it compresses the biasing member 156, and the blades 114 may be returned to the extended position. Accordingly, the blades 114 may be movable between the extended position and the retracted position, the travel sleeve 118 may be in the second sleeve position, and the trigger sleeve 136 may be in the unobstructed position when the expandable reamer 100 is in the second operational state.

Referring to FIG. 4, a cross-sectional view of the expandable reamer 100 of FIG. 1 is shown in a third operational state (e.g., a third mode of operation). Such a third operational state may correspond to a de-activated, final, retracted state, and may reflect a state of the expandable reamer 100 after reaming the borehole is complete and during removal of the expandable reamer 100 from the borehole. The actuation mechanism of the expandable reamer 100 may be deactivated to return the blades 114 to their retracted positions and to significantly reduce the likelihood that that blades 114 will move to the extended position responsive to increases in drilling fluid pressure (e.g., to prevent the blades 114 from moving to the extended position responsive to increases in drilling fluid pressure).

To place the expandable reamer 100 in the third operational state, a second obstruction 158 may be released into the internal bore 104 to engage with the second obstruction engagement 144 of the trigger sleeve 136. The second obstruction 158 may comprise, for example, a ball, a sphere, an ovoid, or other three-dimensional shape that may be released into the internal bore 104 to engage with the second obstruction engagement 144 and at least partially impede flow of drilling fluid out the lower end 146 of the trigger sleeve 136. A second outer diameter $OD_2$ of the second obstruction 158 may be larger than the second inner diameter $ID_2$ of the second obstruction engagement 144, which may cause the second obstruction 158 to engage with (e.g., become lodged in) the second obstruction engagement 144.

After engaging with the second obstruction engagement 144, drilling fluid pressure against the second obstruction 158 may increase as flow out the lower end 146 of the trigger sleeve 136 is at least partially impeded. The pressure exerted by the drilling fluid may be sufficient to disconnect the trigger sleeve 136 from the travel sleeve 118. For example, the pressure exerted by the drilling fluid may produce a shear stress within the detachable hardware 120B greater than a shear strength of the detachable hardware 120B (see FIGS. 2 and 3) to shear the detachable hardware 120B in embodiments where the detachable hardware 120B comprises shear pins or shear screws. The pressure exerted by the drilling fluid may then cause the trigger sleeve 136 to move from the unobstructed position to an obstructed position. For example, the pressure may cause the trigger sleeve 136 to move from an unobstructed position in which the trigger ports 142 are at least substantially aligned with the second ports 130 of the travel sleeve 118 to an obstructed position in which the sidewall 138 of the trigger sleeve 136 obstructs the second ports 130. Movement of the trigger sleeve 136 may be arrested in the obstructed position by reducing or relieving the pressure exerted by the drilling fluid, by abutting the lower end 146 of the trigger sleeve 136 against the travel sleeve 118 (e.g., against a sleeve stop 148B of the travel sleeve 118), or both. In embodiments where the lower end 146 of the trigger sleeve 136 abuts the sleeve stop 148B, a seal may not be formed between the trigger sleeve 136 and the sleeve stop 148B to enable drilling fluid to still flow out the trigger ports 142 and the first ports 126, into the internal bore 104, and out of the housing 102. For example, the lower end 146 of the trigger sleeve 136, the sleeve stop 148B, or both may comprise a scalloped edge or a scalloped surface to create a space in which drilling fluid may flow.

When the trigger sleeve 136 moves from the unobstructed position to the obstructed position, the trigger ports 142 of the trigger sleeve 136 may move from the first side of the sealing members 132 to the second, opposing side of the sealing members 132. For example, the trigger ports 142 may move from a first side above the sealing members 132 (see FIGS. 2 and 3) to a second side below the sealing members 132, which may cause the trigger ports 142 to at least substantially align with the first ports 126 of the travel sleeve 118. Movement of the trigger ports 142 out of at least substantial alignment with the second ports 130 of the travel sleeve 118 may cause the sidewall 138 of the trigger sleeve 136 to obstruct the second ports 130 (as shown in dashed lines). Drilling fluid may then escape from the internal flow bore 140, through the trigger ports 142 and the first ports 126, to the internal bore 104 of the housing 102, and out the lower end 110 of the housing 102 to at least partially relieve the pressure exerted by the drilling fluid against the second obstruction 158. In addition, drilling fluid may be redirected from flowing through the second ports 130, to the internal flow bore 140, through the trigger ports 142 and the first ports 126, to the internal bore 104 of the housing 102, and out the lower end 110 of the housing 102 to at least partially relieve the pressure exerted by the drilling fluid against the push sleeve 154. The second obstruction 158 may remain engaged with the second obstruction engagement 144 during and after movement of the trigger sleeve 136 because at least substantial alignment between the trigger ports 142 and the first ports 126 may enable drilling fluid to be redirected around the second obstruction 158. In some embodiments, drilling fluid may be expelled from the internal bore 104, through a relief valve 160, and out to an exterior of the expandable reamer 100 to at least partially relieve the pressure exerted by the drilling fluid against the push sleeve 154.

Reduction in the pressure exerted by the drilling fluid against the push sleeve 154 may cause the blades 114 to return to the retracted position. For example, the pressure of the drilling fluid may be less than a pressure exerted by the biasing member 156 against the push sleeve 154. The pressure exerted by the biasing member 156 against the push sleeve 154 may move the push sleeve 154 (e.g., by expanding the biasing member 156), overcome the pressure exerted by the drilling fluid, and cause the blades 114 to move to the retracted position.

The return of the blades 114 to the retracted position may last for at least as long as the expandable reamer 100 remains in the borehole. For example, obstruction of the second ports 130 by the sidewall 138 of the trigger sleeve 136 may significantly reduce (e.g., eliminate) the likelihood that increases in pressure exerted by the drilling fluid will be sufficient to overcome the bias of the biasing member 156 and move the blades 114 to the extended position. For example, the blades 114 may remain in the retracted position regardless of increases or decreases in pressure exerted by the drilling fluid because of the redirection of flow from the push sleeve 154, which may be caused by blocking transmission of fluid pressure to the push sleeve 154 by obstructing the second ports 130 with the sidewall 138 of the trigger sleeve 136, through the trigger and first ports 142 and 126, out into the internal bore 104 of the housing 102. Accordingly, the blades 114 may be in the retracted position, the travel sleeve 118 may be in the second sleeve position, and the trigger sleeve 136 may be in the obstructed position when the expandable reamer 100 is in the third operational state.

While certain illustrative embodiments have been described in connection with the figures, those of ordinary skill in the art will recognize and appreciate that embodiments of the invention are not limited to those embodiments explicitly shown and described herein. Rather, many additions, deletions, and modifications to the embodiments described herein may be made without departing from the scope of embodiments of the invention as hereinafter claimed, including legal equivalents. In addition, features from one disclosed embodiment may be combined with features of another disclosed embodiment while still being encompassed within the scope of embodiments of the invention as contemplated by the inventors.

What is claimed is:

1. An expandable reamer for use in a borehole in a subterranean formation, comprising:

a housing defining an internal bore;

at least one blade supported by the housing, the at least one blade being movable between an extended position and a retracted position;

a travel sleeve located within the internal bore and detachably connected to the housing, the travel sleeve defining an internal flow path and comprising a first obstruction engagement, at least one first port at a first longitudinal position, and at least one second port at a second, upper longitudinal position, wherein the travel sleeve is located in a first sleeve position when connected to the housing and is movable from the first sleeve position to a second, different sleeve position when disconnected from the housing; and a trigger sleeve located within the internal flow path of the travel sleeve and detachably connected to the travel sleeve, the trigger sleeve defining an internal flow bore and comprising a second obstruction engagement, wherein the trigger sleeve is located in an unobstructed position in which the at least one second port is unobstructed by the trigger sleeve when the trigger sleeve is connected to the travel sleeve and the trigger sleeve is movable from the unobstructed position to an obstructed position in which the at least one second port is obstructed by the trigger sleeve when the trigger sleeve is disconnected from the travel sleeve, wherein the at least one blade is in the retracted position when the travel sleeve is in the first sleeve position and the trigger sleeve is in the unobstructed position, the at least one blade is movable to the extended position when the travel sleeve is in the second sleeve position and the trigger sleeve is in the unobstructed position, and the at least one blade is in the retracted position when the travel sleeve is in the second sleeve position and the trigger sleeve is in the obstructed position.

2. The expandable reamer of claim 1, wherein the trigger sleeve further comprises at least one trigger port and wherein the at least one trigger port is at least substantially aligned with the at least one second port when the trigger sleeve is in the unobstructed position.

3. The expandable reamer of claim 2, wherein the at least one trigger port is at least substantially aligned with the at least one first port when the trigger sleeve is in the obstructed position.

4. The expandable reamer of claim 1, wherein the trigger sleeve further comprises a sidewall and wherein the sidewall obstructs the at least one second port when the trigger sleeve is in the obstructed position.

5. The expandable reamer of claim 1, further comprising at least one sealing member interposed between the housing and the travel sleeve to form a seal between the housing and the travel sleeve and wherein the at least one first port is located on a first side of the at least one sealing member when the travel sleeve is in the first sleeve position and is located on a second, opposing side of the at least one sealing member when the travel sleeve is in the second sleeve position.

6. The expandable reamer of claim 1, wherein the travel sleeve is configured to disconnect from the housing when a first obstruction is engaged with the first obstruction engagement.

7. The expandable reamer of claim 6, wherein the trigger sleeve is configured to disconnect from the travel sleeve when a second obstruction is engaged with the first obstruction engagement.

8. The expandable reamer of claim 1, wherein the first obstruction engagement is positioned longitudinally below the trigger sleeve.

9. The expandable reamer of claim 8, wherein the first obstruction engagement comprises a first inner diameter and the second obstruction engagement comprises a second, greater inner diameter.

10. The expandable reamer of claim 1, further comprising locking dogs configured to retain the at least one blade in the retracted position when the travel sleeve is in the first longitudinal position and to release the at least one blade when the travel sleeve is in the second sleeve position.

11. The expandable reamer of claim 1, wherein the at least one blade is biased toward the retracted position.

12. A method of using an expandable reamer in a borehole, comprising:

flowing a drilling fluid through an internal bore defined by a housing, through an internal flow path defined by a travel sleeve located within the internal bore and detachably connected to the housing, and through an internal flow bore defined by a trigger sleeve located within the internal flow path of the travel sleeve and detachably connected to the travel sleeve;

releasing a first obstruction into the internal bore to engage with a first obstruction engagement of the travel sleeve;

disconnecting the travel sleeve from the housing and allowing the travel sleeve to move from a first sleeve position to a second, different sleeve position when the first obstruction is engaged with the first obstruction engagement;

extending at least one blade supported by the housing from a retracted position to an extended position in response to movement of the travel sleeve from the first sleeve position to the second sleeve position;

releasing a second obstruction into the internal bore to engage with a second obstruction engagement of the trigger sleeve;

disconnecting the trigger sleeve from the travel sleeve and allowing the trigger sleeve to move from an unobstructed position in which at least one second port of the travel sleeve is unobstructed by the trigger sleeve to an obstructed position in which the at least one second port is obstructed by the trigger sleeve;

redirecting flow of the drilling fluid from the at least one second port through the internal flow path; and allowing the at least one blade to retract from the extended position to the retracted position in response to the redirected flow of the drilling fluid.

13. The method of claim 12, wherein allowing the trigger sleeve to move from the unobstructed position to the obstructed position comprises allowing the trigger sleeve to move from an unobstructed position wherein at least one trigger port of the trigger sleeve is at least substantially aligned with at least one second port of the travel sleeve to an obstructed position wherein a sidewall of the trigger sleeve obstructs the at least one second port.

14. The method of claim 12, wherein redirecting flow of the drilling fluid from the at least one second port comprises obstructing the at least one second port with a sidewall of the trigger sleeve.

15. The method of claim 12, wherein allowing the travel sleeve to move from the first sleeve position to the second, different sleeve position comprises allowing at least one first port of the travel sleeve to move from a first side of at least one sealing member interposed between the housing and the travel sleeve to a second, opposing side of the at least one sealing member.

16. The method of claim 15, wherein allowing the trigger sleeve to move from the unobstructed position to the obstructed position comprises allowing at least one trigger port of the trigger sleeve to at least substantially align with the at least one first port of the travel sleeve.

17. The method of claim 12, wherein releasing the second obstruction comprises releasing a second obstruction having a second outer diameter larger than a first outer diameter of the first obstruction.

18. The method of claim 12, wherein allowing the travel sleeve to move from the first sleeve position to the second, different sleeve position comprises releasing locking dogs configured to retain the at least one blade in the retracted position in response to movement of the travel sleeve from the first sleeve position to the second sleeve position.

19. The method of claim 12, further comprising:

decreasing a pressure of the drilling fluid flowing through the internal bore while the travel sleeve is in the second sleeve position and the trigger sleeve is in the unobstructed position;

allowing the at least one blade to retract to the retracted position in response to the decrease in the pressure;

increasing the pressure of the drilling fluid; and extending the at least one blade to the extended position in response to the increase in the pressure.

20. The method of claim 12, wherein allowing the at least one blade to retract from the extended position to the retracted position when the travel sleeve is in the second sleeve position and the trigger sleeve is in the obstructed position comprises allowing the at least one blade to retract to the retracted position for at least as long as the expandable reamer remains in the borehole.

* * * * *